US007334447B1

(12) United States Patent
Kulkarni et al.

(10) Patent No.: US 7,334,447 B1
(45) Date of Patent: Feb. 26, 2008

(54) NACELLE NOSE CAP FORMING METHOD AND APPARATUS

(75) Inventors: Pravin Kulkarni, Wichita, KS (US); Prabhakar Shashikiran, Wichita, KS (US)

(73) Assignee: Cessna Aircraft Company, Wichita, KS (US)

( * ) Notice: Subject to any disclaimer, the term of this patent is extended or adjusted under 35 U.S.C. 154(b) by 0 days.

(21) Appl. No.: 11/067,176

(22) Filed: Feb. 28, 2005

(51) Int. Cl.
*B21D 22/00* (2006.01)
*B21D 45/00* (2006.01)
*B21D 31/00* (2006.01)

(52) U.S. Cl. ..... 72/350; 72/334; 72/347; 72/379.2

(58) Field of Classification Search ..... 72/350, 72/333, 334, 347, 348, 356, 379.2
See application file for complete search history.

(56) References Cited

U.S. PATENT DOCUMENTS 3,475,944 A 11/1969 Marsner
3,768,295 A 10/1973 Cudzik
3,802,245 A * 4/1974 Garner et al. ..... 72/348
5,088,870 A 2/1992 Fukuhara et al.
5,634,366 A 6/1997 Stodd
6,505,492 B2 1/2003 Jroski
6,588,087 B1 7/2003 Collins
2004/0226333 A1 * 11/2004 Kato et al. ..... 72/68

* cited by examiner

*Primary Examiner*—Derris H. Banks
*Assistant Examiner*—Teresa M. Bonk
(74) *Attorney, Agent, or Firm*—Robert O. Blinn

(57) ABSTRACT

A method and apparatus for draw forming a flat sheet blank into a 3-dimensional-nacelle nose cap for an aircraft engine in two stages; the blank having an outer annular portion and an inner annular portion. Draw forming the inner annular portion into a shape of an arcuate circular inner wall and then draw forming the outer annular portion into an arcuate outer wall adjacent the inner wall with the combination of walls being U-shaped in cross section.

5 Claims, 3 Drawing Sheets

NACELLE NOSE CAP FORMING METHOD AND APPARATUS

FIELD OF THE INVENTION

The present invention relates to a method and apparatus for deep drawing a metal blank and in particular to the forming process used to form nacelle nose caps for jet engines using aluminum alloy and steel alloy sheet metal.

BACKGROUND OF THE INVENTION

Traditionally, jet engine nose caps or nose cap rings are draw formed in multiple stages with intermediate heat treatments on a draw die or a hydro press or a combination of both. The tools represent the final part geometry in cross-section. The intermediate stages are formed by withdrawing the punch when it's partly immersed in the die. The punch travel is restricted by temporarily filling the die cavity with a filler material such as rubber, to reduce its depth. Generally sheets of flat rubber or custom fit resin plugs are used for this purpose. This process is non-optimal as the staging of the process is arbitrary and the process has a very high scrap rate between 50%-70% and, therefore, very low yield. The choice and number of intermediate forming stages and heat treatments depends on the individual forming the parts and the depth to diameter ratio of the nose caps.

SUMMARY OF THE INVENTION

The process of present invention employs a minimum strain path to deform the metal in forming the nose cap. The process employs the optimal/minimum number of stages required to form nose caps. The nose caps are formed in two stages with or without one intermediate heat treatment. In the first stage, the blank forms an inner arcuate wall of the nose cap ring into a final shape with a single draw of a punch and mating die. In the second stage, the outer arcuate wall of the nose cap ring is formed with a single draw. The selvage edge and selvage center are cut away leaving the nose cap in final shape. The stages can be reversed so the second stage is formed before the first. The invention has equal application where ever a three dimensional annular ring is draw formed. The process can also be used in a hydroforming press where the mating shaped die is a layer of rubber, which deforms around the male punch as they are brought together.

The principal object of the present invention is to provide a draw formed method for a nose cap having less thinning of the metal sheet and therefore more strength than the prior art nose caps.

Another object of the present invention is to provide a method utilizing less time and stages in forming and a decreased scrap rate.

A further object of the present invention is to provide a method of draw forming with only a minimum of forming stages rendering the process less arbitrary as to the intermediate forming stages and less heat treatments Another object of the present invention is to provide a nacelle nose cap having a thinner width than the prior art methods.

Other objects and advantages of the present invention will become apparent as the description therefore proceeds.

BRIEF DESCRIPTION OF THE DRAWINGS

The accompanying drawings which are incorporated in and constitute a part of the specification illustrate the embodiment of the prior art technology and the current invention showing the various method steps necessary to practice the present invention.

DETAILED DESCRIPTION OF THE PREFERRED EMBODIMENT

Figure 1:
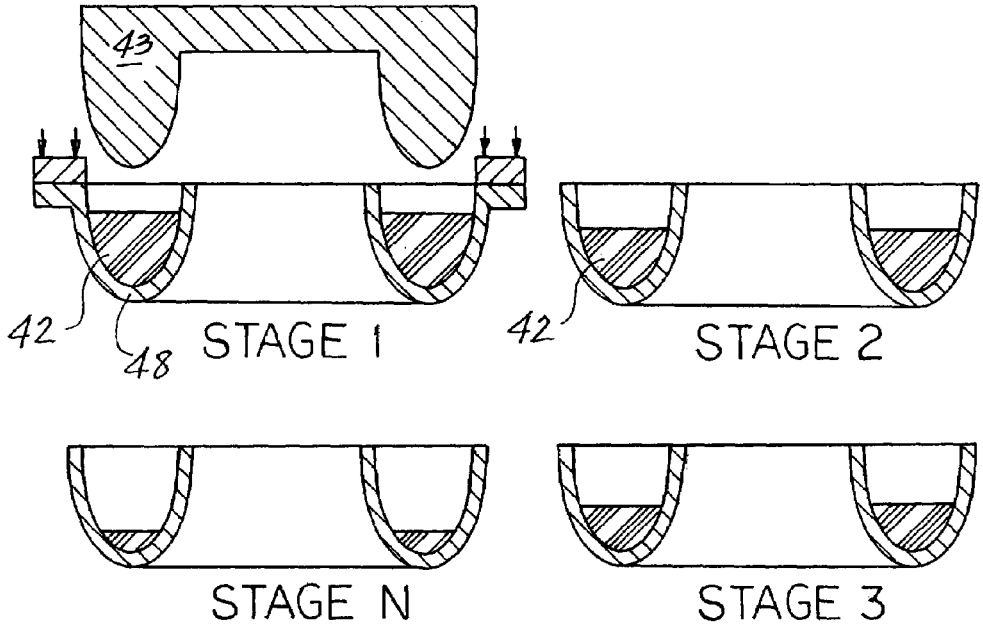
FIG. 1 is the prior art multi-stage forming process for forming the engine nacelle nose caps.

FIG. 1 illustrates the traditional prior art method of draw forming engine nacelle nose caps in multiple stages with intermediate heat treatments between stages. In stage 1 the die 48 is partially filled with a filling material such as rubber 42 to reduce its depth so that the punch 43 is only partially inserted in the die 48. In the stages 2, 3, etc. up to the final stage the amount of filling material is progressively reduced until there is no filler in the final stage 44 with heat treatments provided between stages. The number of stages and heat treatments can vary upwardly depending upon the part geometry and the operator forming the nose caps. Stages 1 through 3 are in a sense a hydroforming press in that there is no mating shaped female die but rather a flat layer of rubber that deforms to the shape of the male punch 43. The final stage is conventional draw forming where there are a pair of mating ridged dies which form the blank.

Figure 2:
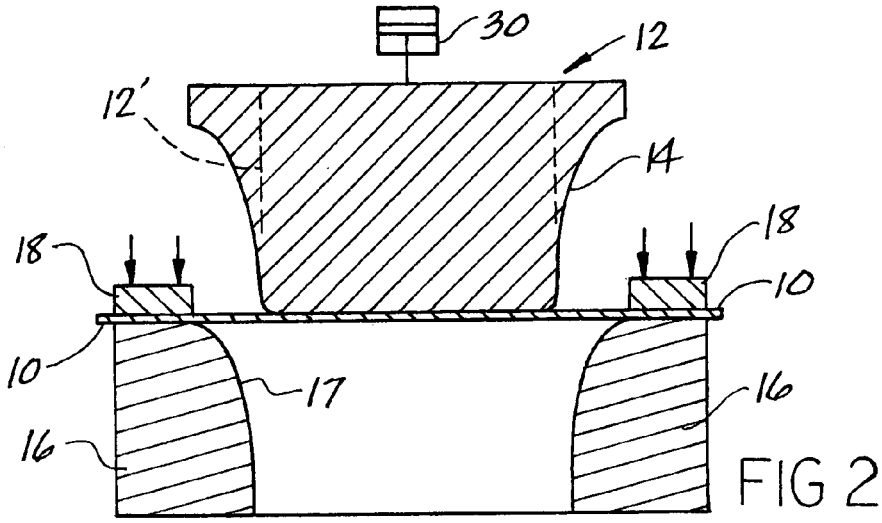
FIG. 2 is a sectional view of the first stage forming process of the present invention prior to forming.
Figure 6:
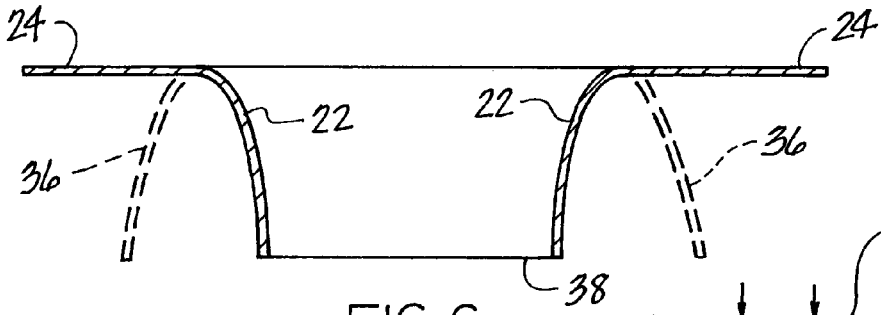
FIG. 6 is a sectional view of an annular blank after removal from the first stage with the second stage forming of the blank shown in dotted lines.

The present invention forming process involves only two stages and the first stage is set up as shown in FIG. 2. A blank 10, which is a circular sheet of aluminum or steel in an annealed condition, is shown positioned between a punch 12 and a female die 16. The blank 10 could also be annular in shape as shown in FIG. 6. The blank is held in place by a holder ring 18, which applies pressure against the die 16 through blank 10 during the forming process. Punch 12 includes an arcuate circular surface 14 around its lower periphery while die 16 includes a similar shaped surface 17. The blank or sheet 10 of aluminum is shown positioned between punch 12 and die 16 and are brought together by a hydraulic ram 30 or any other type of linear actuator means. Either the punch 12 or a die 16 can be stationary while the other moves. An alternate shaped punch 12' is shown in dotted line in FIG. 2 wherein the inner wall 22 of the nose cap is formed by stretching blank 10 over arcuate surface 17 of die 16.

Figure 3:
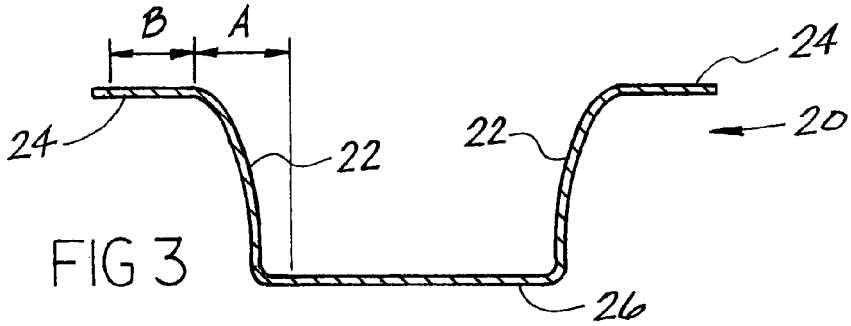
FIG. 3 is a sectional view of a blank as it is removed from the first stage.
Figure 5:
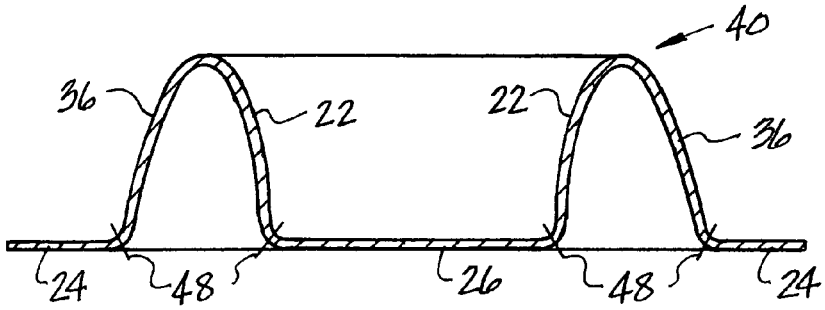
FIG. 5 is a sectional view of the blank after it is formed in the second stage.

With the first stage completed the blank appears as a wide flanged cup 20 as shown in FIG. 3. The blank 20 has an inner circular portion A surrounded by an outer circular portion B. The inner portion A is formed into a curved or arcuate circular inner wall 22 during the first stage of forming while outer circular portion B in the second stage of forming is drawn into a similar arcuate outer wall 36 as shown in FIGS. 5 and 6.

Figure 4:
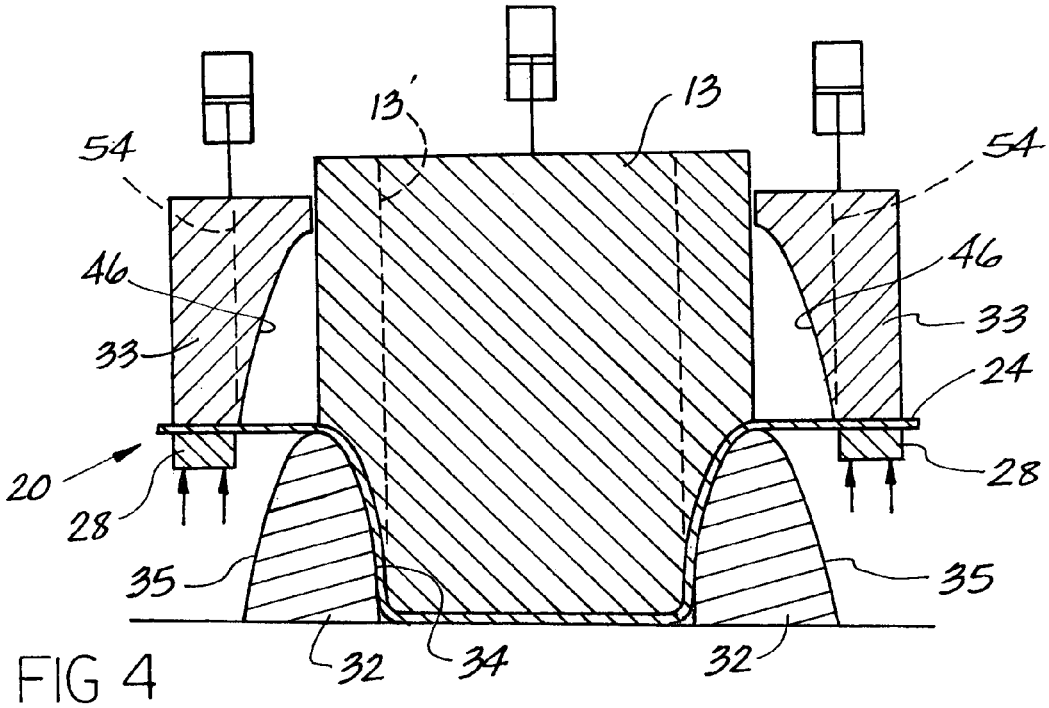
FIG. 4 is a sectional view of the second stage process prior to forming.

In the second stage of forming, blank 20 is placed in die 32 as shown in FIG. 4 with arcuate inner walls 22 resting on the die surface 34. Punch 13, which has a similar shape to punch 12 of the first stage, is brought into contact with cup 20 with cup 20 tightly held between the punch 13 and die 32. Second stage female die 33 is lowered against the selvage edge 24 of the blank 20 while holder ring 28 holds the selvage edge 24 of the blank 20 against female die 33. Female die 33 and holding ring 28 are lowered forming the outer circular portion of the blank B into an arcuate outer wall 36 as shown in FIG. 5. As female die 33 and ring 28 are lowered, the blank 20 is stretched over the outside surface 35 of female die forming an arcuate outer wall 36. When the two die surface 46 and 35 are brought together in contacting relation with blank 20 all the wrinkles and irregularities in the blank 20 are removed from the outer wall 36. Forming wax or any other suitable lubricant is used to lubricate the blank 20 and dies during the process.

Figure 14:
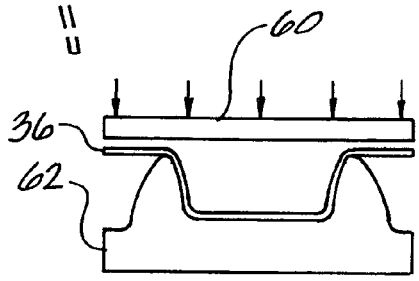
FIG. 14 is a sectional view of a second stage hydroform.

An alternate design for the tooling in stage 2 would be to eliminate the mating arcuate surface 46 on the female die 33 as shown by dotted line 54 whereby wall 36 of the blank was formed strictly from stretching the blank 20 over convex surface 35 of die 32. Another alternate design would be shape the punch 13 as shown by dotted lines 13' in FIG. 4. A further alternate design for stage 2 would be a hydroforming stage where female die 33 was replaced with a layer of rubber 60 which deforms the outer portion of blank 20 against arcuate surface 35 as shown in FIG. 14.

In both stage 1 of FIG. 2 and stage 2 of FIG. 4 requires that the selvage edge 24 of the blank 20 be clamped between the tooling and the holder ring 18 or 28 during both forming stages of the nose cap. After stage 2 is complete, the center of the blank 26 is cut away along with the outer selvage edge 24 as shown by cut lines 48 in FIG. 5, thereby forming a fully formed nose cap ring 40.

Instead of using a circular sheet metal blank 10 as shown in FIG. 2, an annular blank as shown in FIG. 6 could be used having a center opening 38. The first stage tooling with an annular blank would be identical to that shown in FIG. 2 and the second stage tooling would also be identical to that shown in FIG. 4.

Figure 10:
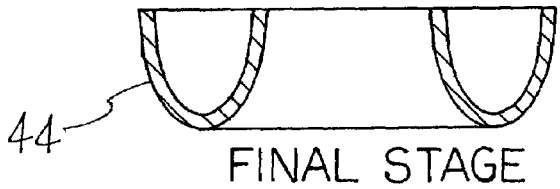
FIG. 10 is an elevational view of a non-circular nose cap with a constant cross-section.
Figure 10:
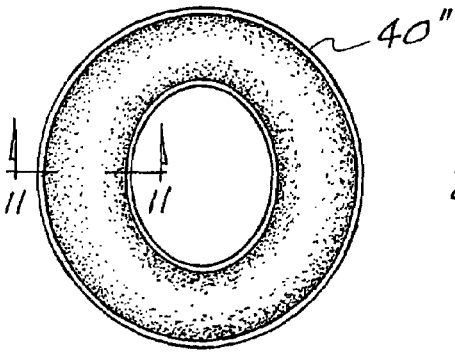
Figure 7:
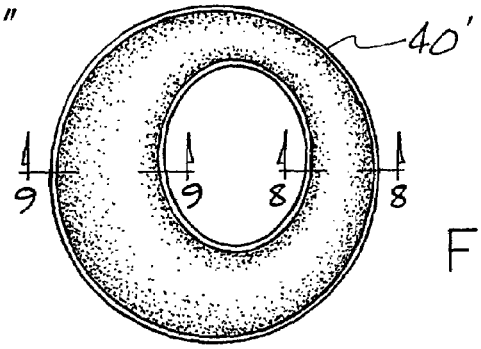
FIG. 7 is an elevational view of a jet engine nacelle nose cap with variable cross-sections.
Figure 11:
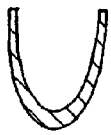
FIG. 11 is a sectional view taken along lines 11-11 of FIG. 10.
Figure 9:
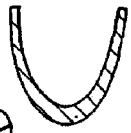
FIG. 9 is a sectional view taken along lines 9-9 of FIG. 7.
Figure 8:
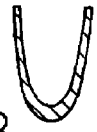
FIG. 8 is a sectional view taken along lines 8-8 of FIG. 7.
Figure 12:
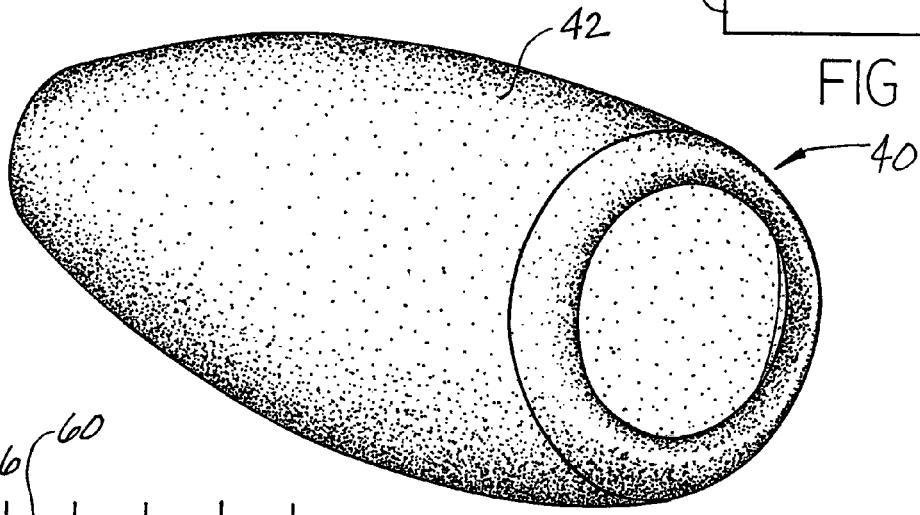
FIG. 12 is a perspective view of a typical jet engine nacelle with its nose cap.

The completely formed nose cap ring 40 mounts on the front of engine nacelle 42 as shown in FIG. 12. Nose cap of 40' as shown in FIG. 7, can have varying radial cross-sections as illustrated in FIGS. 8 and 9. The cross sectional shape of the engine nacelle 42 varies with the particular engine. It can be circular or oblong. The intake opening can be concentric or nonconcentric. In FIG. 10, the nose cap 40", is shown having equal radial cross-sections as shown in FIG. 11, but with a generally oval nacelle.

One advantage with the forming method of the present invention allows the nose cap to be formed with a very narrow width or radial cross-section, which the prior art method is incapable of achieving.

Figure 13:
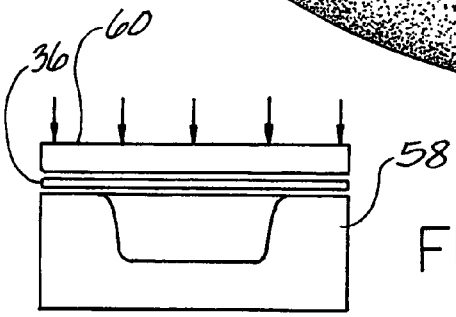
FIG. 13 is a sectional view of a first stage hydroform.

When applying the current invention by hydro-forming, only the female die 58 and deformable rubber sheet 60 would be required in stage one, as shown in FIG. 13. In stage 2 hydroforming (FIG. 14) only the female die 62 would be required and deformable rubber sheet 60.

While this invention has been described as having a preferred design, it is understood that the invention is capable of further modifications, uses, and/or adaptations which follow in general the principal of the present invention and includes such departures from the present disclosure as come within known or customary practice in the forming art and fall within the scope of the limits of the appended claims.

We claim:

1. A method of draw forming a flat sheet annular shaped blank into a three-dimensional nacelle nose cap, the blank having an outer annular portion and a inner annular portion comprising the steps of:

(a) obtaining a first female die having a curved arcuate inner wall, (b) obtaining a punch having a curved arcurate outer wall that matches the curved arcuate inner wall of the female die, (b) securing the flat sheet annular shaped blank to the female die, (c) bringing the female die and the punch together to form the flat blank such that the inner annular portion of the blank defines a cup shaped arcuate inner wall conforming to the shape of curved arcuate inner wall of the female die, (d) obtaining a second die having an inside surface matching the curved arcuate inner wall of the blank formed in step (c), the second die further having a curved arcuate outside surface shaped for forming an curved arcuate outer wall in the blank, (e) placing the blank formed in step (c) into the second die so that the cup shaped arcuate inner wall of the blank fits against the inside surface of the second die, (f) securing the cup shaped portion of the blank formed in step (c) to the second die, (g) obtaining a second stage female die having an inside surface generally corresponding to the curved arcurate outside surface of the second die, (i) securing the periphery of the blank to the second stage female die, (i) bringing the second die together with the second stage female die until the inside surface of the of the second stage female die forms the blank against the curved arcurate outside surface of the second die thereby forming an outside annular wall in the blank, the combination of walls in the blank presenting a U-shaped cross section.

2. The method of claim 1, further comprising the step of cutting away the center area of the blank inside the inner curved arcuate wall and the outer edge of the blank outside the outer curved arcuate wall leaving a ring having inner and outer curved arcuate side walls.

3. The method of claim 1, including the additional steps of:

obtaining a second stage punch for securing the cup shaped portion of the blank formed in step (c) to the second die, placing the blank between the second die and the second stage punch, and, clamping the blank to the to the second die by bringing the second stage punch and the second die together.

4. The method of claim 1, including the additional steps of:

obtaining a holding ring, and securing the periphery of the blank to the second stage female die by pressing the periphery of the blank between the second stage female die and the holding ring.

5. The method of claim 1, including the additional steps of:

obtaining a second stage punch for securing the cup shaped portion of the blank formed in step (c) to the second die, placing the blank between the second die and the second stage punch, and, clamping the blank to the to the second die by bringing the second stage punch and the second die together, and, obtaining a holding ring, and securing the periphery of the blank to the second stage female die by pressing the periphery of the blank between the second stage female die and the holding ring.

* * * * *